US012460902B2

(12) United States Patent
Lehmann, Jr. et al.

(10) Patent No.: US 12,460,902 B2
(45) Date of Patent: Nov. 4, 2025

(54) HANDGUN WEDGE STABILIZING BRACE

(71) Applicant: Harley Obi LLC, Elmsford, NY (US)

(72) Inventors: John C. Lehmann, Jr., Ossining, NY (US); Philine G. Lehmann, Ossining, NY (US)

(73) Assignee: Harley Obi LLC, Elmsford, NY (US)

( * ) Notice: Subject to any disclaimer, the term of this patent is extended or adjusted under 35 U.S.C. 154(b) by 0 days.

(21) Appl. No.: 18/669,422

(22) Filed: May 20, 2024

(65) Prior Publication Data

US 2025/0231005 A1 Jul. 17, 2025

Related U.S. Application Data

(60) Provisional application No. 63/577,787, filed on May 20, 2023.

(51) Int. Cl.
*F41C 23/12* (2006.01)

(52) U.S. Cl.
CPC ..... *F41C 23/12* (2013.01)

(58) Field of Classification Search
CPC ..... F41C 23/00; F41C 23/12; F41C 23/10
USPC ..... 42/71.01–73
See application file for complete search history.

(56) References Cited

U.S. PATENT DOCUMENTS

| | | | | |
|---|---|---|---|---|
| 1,357,232 | A * | 11/1920 | Green | F41C 23/14 42/73 |
| 1,569,901 | A * | 1/1926 | Virdin | F41C 23/00 42/72 |
| 9,696,110 | B2 | 7/2017 | Hollis | |
| 10,571,219 | B2 | 2/2020 | Wilson et al. | |
| 11,754,367 | B2 | 9/2023 | Reavis, III | |
| 2016/0178315 | A9 | 6/2016 | Bosco | |

* cited by examiner

*Primary Examiner* — Reginald S Tillman, Jr.
(74) *Attorney, Agent, or Firm* — Peter A. Borsari; Edison Law Group

(57) ABSTRACT

A handgun wedge stabilizing brace ("HWSB") comprising a stabilizing body and a support member which can be removably connected to a handgun. The stabilizing body braces the handgun against the shooting side of the front of the user's front torso below the shoulder and stabilizes it by being introduced between the side of the user's body torso below the shoulder and upper arm. One end of the support member is telescopically receivable into the stabilizing body and can be adjusted to the desired position by the user. The other end of the support member is removably connected to the rear end of a hand gun, particularly a heavy pistol. The handgun wedge stabilizing brace improves shooting control and stability when using a handgun, especially for one-handed shooters and individuals with a disability.

16 Claims, 3 Drawing Sheets

HANDGUN WEDGE STABILIZING BRACE

CROSS-REFERENCE TO RELATED APPLICATIONS

This application claims priority from U.S. Provisional Patent Application 63/577,787, filed May 20, 2023, entitled Rearward Non-Shoulderable Pistol Wedge Stabilizing Brace, the entirety of which is incorporated herein by reference.

FIELD OF INVENTION

The present invention relates to handgun wedge stabilizing brace attachment for a handgun. More particularly, the present invention relates to a handgun wedge stabilizing brace attachment for a handgun that engages the user's front torso of the user's shooter side below the shoulder and further wedges between the user's side of the front torso below the shoulder and upper arm.

BACKGROUND OF THE INVENTION

The safety, accuracy, and proficiency of the firing of a firearm greatly depends upon the user's ability to hold the firearm in a steady position while aiming and firing, which becomes more difficult during the one-handed operation of a handgun. Holding a handgun in a steady position can be an even more difficult challenge to a person having a physical disability that prevents that person from being able to firmly grip or steady the handgun for any appreciable length of time to permit safe accurate aiming and firing. This issue becomes a greater challenge when the weight of the handgun is concentrated forwardly of the handgun's grip and causes the handgun to want to dip downward (a "heavy pistol"); thus, requiring the user to compensate for this imbalance by continuously applying an upwardly force upon the grip to bring the heavy pistol into a correct firing position. The present invention is intended primarily to be utilized in conjunction with heavy pistols.

PRIOR ART

The prior art is replete with devices that attach to the rear of a pistol, particularly to heavy pistols, in order to aid a person, especially those with a disability, in safely, accurately, and effectively holding and stabilizing the heavy pistol while aiming and firing. For example, U.S. Pat. No. 11,754,367 B2 to Reavis III discloses a handgun brace which utilizes a user's wrist. Similarly, U.S. Patent Application Publication 2016/0178315 A9 to Bosco and U.S. Pat. No. 10,571,219 B2 to Wilson et al. relate to stabilizing braces which engage the user's forearm. And, U.S. Pat. No. 9,696,110 B2 to Hollis teaches a firearm support brace which engages the user's upper arm.

Although these prior art devices may assist in one handed operation of heavy pistols, none of these references utilize both a brace and wedge to provide the heightened level of stability that is provided by the handgun wedge stabilizing brace of the present subject matter. Indeed, the handgun wedge stabilizing brace of the present invention can effectively assist a user, particularly those with a disability, in firmly griping, stabilizing, and aiming a heavy pistol for an appreciably period of time in a safe and controlled manner.

SUMMARY OF THE INVENTION

The present subject matter is directed to a handgun wedge stabilizing brace attachment for a handgun that engages the user's front torso of the user's shooter side below the shoulder and further wedges between the user's side of the front torso below the shoulder and upper arm. In particular, the handgun wedge stabilizing brace comprises two conjoined elements, a stabilizing body designed to contact the body of the user and a support structure facilitating connection to the rear of a handgun.

Accordingly, it is an object of the present subject matter to provide a handgun wedge stabilizing brace which engages the front torso of the user's shooting side below the shoulder and further wedges between the user's torso below the shoulder and the upper arm.

It is another object of the present subject matter to provide a handgun wedge stabilizing brace which can be readily and removably connected to a handgun.

It is an additional object of the present subject matter to provide a handgun wedge stabilizing brace which can be used with a heavy pistol having a large amount of weight located forwardly of the heavy pistol's grip that diminishes or alleviates the strain on the user to properly stabilize and hold the heavy pistol in a correct firing position.

It is a further object of the present subject matter to provide a handgun wedge stabilizing brace to effectively assist the user in firmly gripping, stabilizing, and aiming a heavy pistol for an appreciably period of time in a safe and controlled manner.

It is an additional object of the present subject matter to provide a handgun wedge stabilizing brace to effectively assist a user with a disability in firmly gripping, stabilizing, and aiming a heavy pistol for an appreciably period of time in a safe and controlled manner.

It is a further object of the present subject matter to provide a handgun wedge stabilizing brace that can be utilized for one-handed operation of a handgun.

It is still another object of the present subject matter to provide a handgun wedge stabilizing brace that is constructed of one or more types of rigid material.

It is a yet another object of the present subject matter to provide a handgun wedge stabilizing brace which can be used on either the right side of the left side of the user's body.

It is an additional object of the present invention to provide a handgun wedge stabilizing brace having a support structure constructed with a vertical tubular member that attaches to a protrusion extending from the rear of a handgun and a horizontal tube member to be telescopically receivable along the rear portion of support structure.

It is a still a further object of the present subject matter to provide a handgun wedge stabilizing brace attachment secured to a heavy pistol that utilizes together the shooting side of the front of the user's body torso below the shoulder, the side of the user's body torso below the shoulder, and the upper arm to stabilize and brace the handgun, primarily heavy pistols, to improve control.

These and other objects of the present subject matter are accomplished by providing a handgun stabilizing wedge brace comprising a stabilizing body designed to contact and engage the user's front torso and a support structure which facilitates connection to a handgun, particularly a heavy pistol.

BRIEF DESCRIPTION OF DRAWINGS

The following drawings are intended to illustrate by way of example and are included to provide further understanding of the present subject matter for the purpose of illustrative discussion of the embodiments of the invention. No attempt is made to show structural details of the embodiments in more detail than is necessary for a fundamental understanding of the invention. It will be obvious to those skilled in the art that the following description in combination with the drawings disclose how the several forms of the invention may be embodied in practice.

DETAILED DESCRIPTION OF THE INVENTION

In the following description, like reference numbers are used to identify like elements. Furthermore, the drawings are intended to illustrate major features of exemplary embodiments in a diagrammatic manner. The drawings are not intended to depict every feature of every implementation nor relative dimensions of the depicted elements and are not drawn to scale. In the following description, numerous specific details are set forth to clearly describe various specific embodiments disclosed herein. One skilled in the art, however, will understand that the presently claimed invention may be practiced without all the specific details discussed below. In other instances, well known features have not been described so as not to obscure the invention.

The handgun wedge stabilizing brace may hereinafter sometimes be referred to HWSB. Further, it should be noted that in this description, direction terms, such as "vertical", "horizontal", "perpendicular", "parallel", "angled", "top", "front", "rear", "rearward" and the like are used for convenience in referring to the accompanying drawings and the elements comprising the HWSB.

Figure 1:
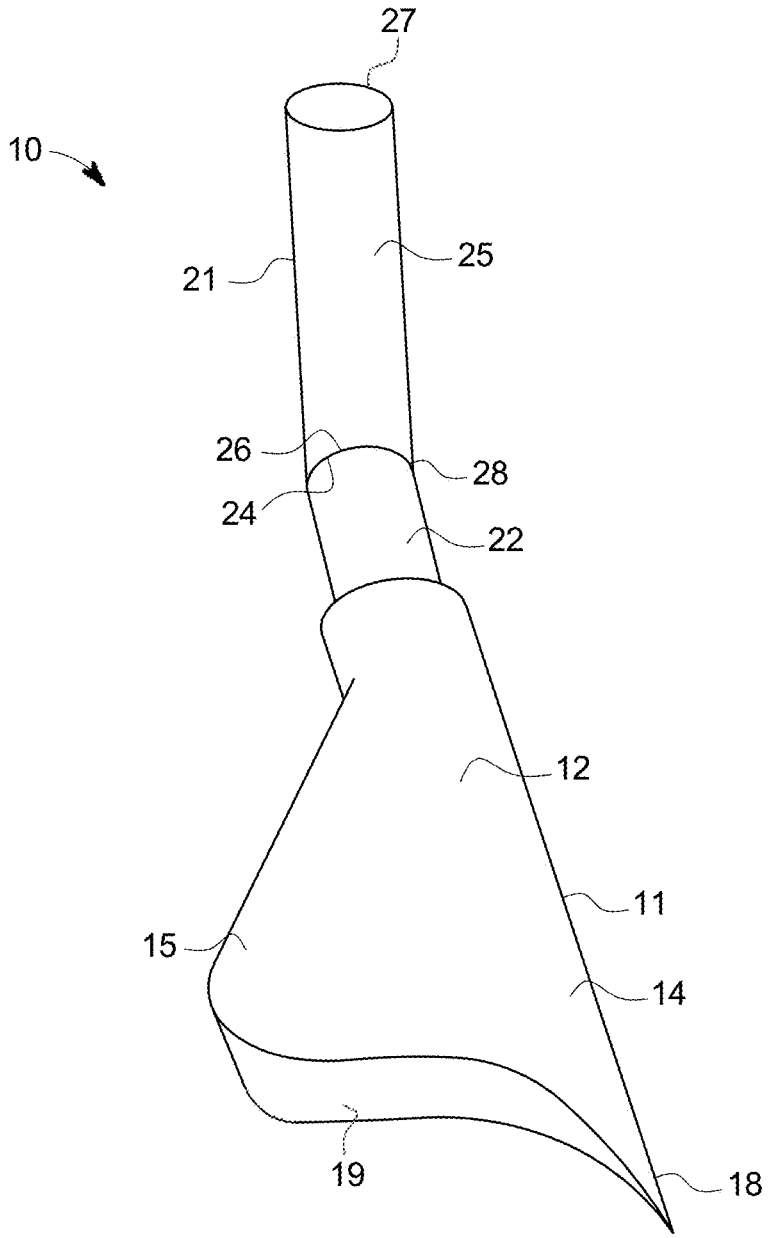
FIG. 1 is a left-side and rear elevation view of the handgun wedge stabilizing brace of the present subject matter, configured for a right-handed user.

The present subject matter is directed to a handgun wedge stabilizing brace. Referring now to FIG. 1, the HWSB 10 comprises two distinct conjoined pieces, a stabilizing body 11 and a support member 21. Both pieces are composed of a rigid material which may be composed of the same material or different materials. As a non-limiting example, one piece may be composed of plastic and the other piece may be composed of metal. The stabilizing body 11 generally is in the form of a triangular shape comprising a pipe section 12, a wedge section 14 and a brace section 15. As shown particularly in FIG. 2 and FIG. 3, the pipe section 12 is provided with a tubular passage 16. The tubular passage 16 extends through the pipe section 12 and terminates at a point near the front end 17 of wedge section 14. The brace section 15 protrudes from the side of the pipe section 12 on the side opposite of the user's grip hand. The brace section is provided with sufficient surface area 19 to laterally brace against the part of the user's front torso. The wedge section 14 is in the form of a triangular protrusion rearwardly extending from the rear of the pipe section 12, terminating into a pointed end 18 which is designed to conformingly fit within the gap between the user's side body torso below the shoulder and upper arm.

Figure 5:
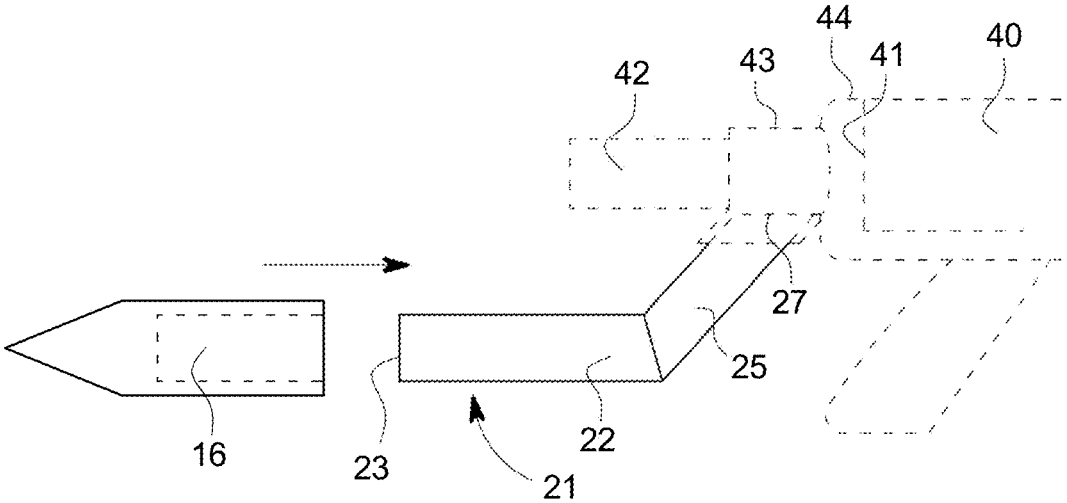
FIG. 5 is a right-side view of the handgun wedge stabilizing brace of the present subject matter configured for a right-handed user, illustrating a supporting structure coupled with one embodiment of a heavy pistol and the telescopic capability of the stabilizing body.

As best illustrated in FIGS. 1 and 5, the support member 21 generally is in the form of an obtusely angled tube comprising a horizontal tubular portion 22 having a proximal end 23 and a distal end 24 and a vertical tubular portion 25 having a proximal end 26 and a distal end 27, the proximal end 26 of the vertical tubular portion 25 extending upwardly at an angle 28 from the distal end 24 of the horizontal tubular portion 22. In one embodiment, the distal end 24 of the horizontal tubular portion 22 is coupled with the proximal end 26 of the vertical tubular portion 25. In another embodiment, the horizontal tubular portion 22 and the vertical tubular portion can be manufactured as a single piece. The proximal end 23 of the horizontal tubular member 22 is designed to be telescopically received into the tubular passage 16 of stabilizing body 11, thereby detachably connecting the support member 21 to the stabilizing body 11. The horizontal tubular member 22 can be telescopically adjusted within the tubular passage by and suitable mechanism which will lock the horizontal tubular member 22 into the desired position within the tubular passage. Such mechanisms are well known to those skilled in the art. The distal end 27 of the vertical tubular member 25 is configured to be removably connected the rear end of a handgun.

Figure 2:
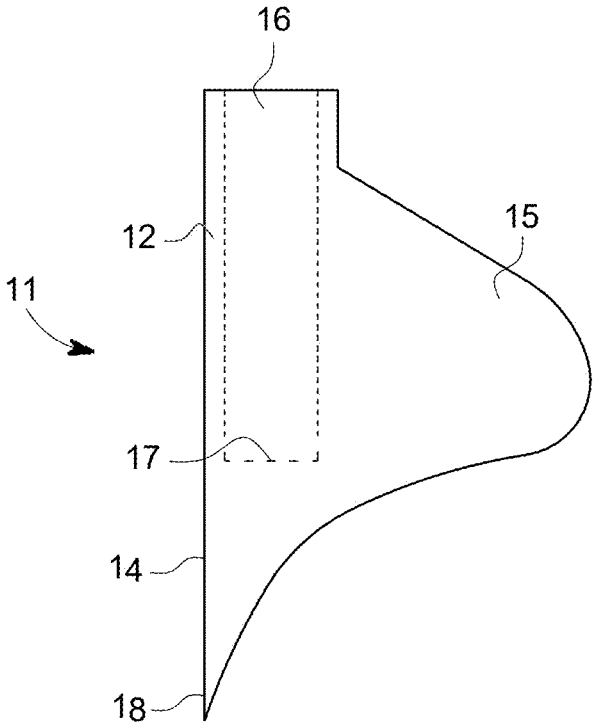
FIG. 2 is a top elevation view of the stabilizing brace portion of the handgun wedge stabilizing brace of the present subject matter, configured for a left-handed user
Figure 3:
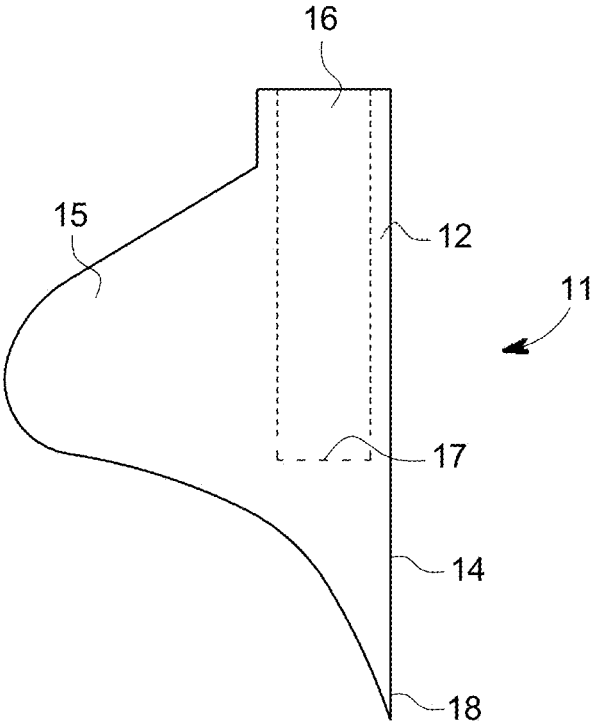
FIG. 3 is a top elevation view of the stabilizing brace portion of the handgun wedge stabilizing brace of the present subject matter, configured for a right-handed user.

FIG. 2 and FIG. 3, illustrate the ambidextrous capability of the handgun wedge stabilizing brace of the present subject matter. Referring to FIG. 2, the stabilizing body 11 is positioned for a left-handed user, such that the brace section 15 is located perpendicularly to the upright heavy pistol along the right side of the pipe section 12. Referring now to FIG. 3, the stabilizing body 11 is positioned for a right-handed user, such that the brace section 15 is located perpendicularly to the upright heavy pistol along the left side of the pipe section 12.

Figure 4:
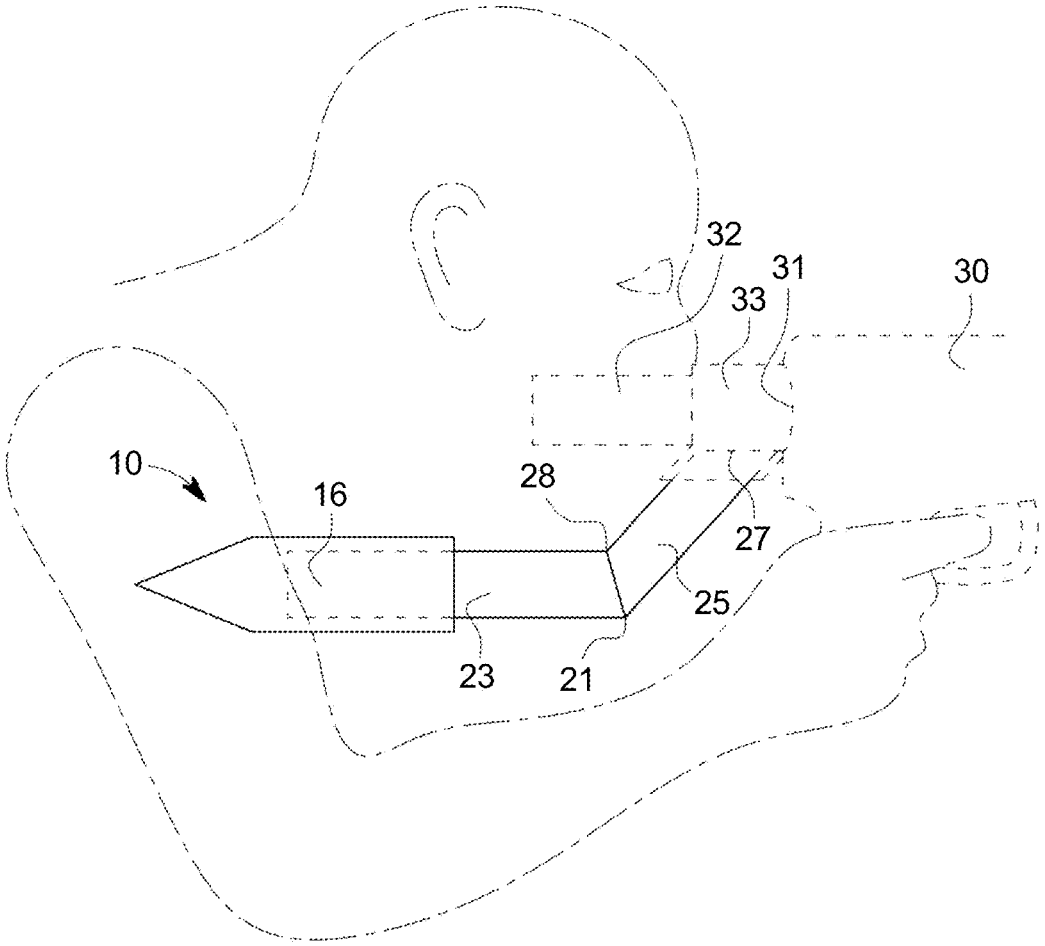
FIG. 4 is a right-side view of the handgun wedge stabilizing brace of the present subject matter connected to a heavy pistol and configured for a right-handed user.

The HWSB 10 of the present subject matter can be readily and removably secured to a heavy pistol in several different configurations. Referring to FIG. 4, a heavy pistol 30 is shown having an integral buffer tube 32 that extends rearwardly from the rear 31 of the heavy pistol and which provides suitable support upon which the distal end 27 of the vertical tubular portion 25 of the HWSB 10 may be coupled to the heavy pistol 30 by a clamp 33 or similar connecting means as will be obvious to those skilled in the art.

However, not all heavy pistols are provided with an integral buffer tube or similar tubular support or structure that extends from the rear of the heavy pistol. Referring now to FIG. 5, a heavy pistol 40 is shown having a rear end 41. In this embodiment, it is contemplated that a suitable structure, such as a tubular member 42 extends rearwardly outward from the rear end 41 of the heavy pistol 40 by a bracketing means 44. In this manner, the tubular support member 42 and bracketing means 44 to the heavy pistol 40 provides a suitable support to which the HWSB 10 may be removably secured to the distal end 27 of the vertical tubular portion 25 by means of a suitable connecting means, for example, clamping mechanism 43. As will be obvious to those skilled in the art, there are a myriad of possible bracket configurations that could be utilized to complement various heavy pistol structures to securely attach a tubular member 42 to the rear end of the heavy pistol.

Accordingly, the hand wedge stabilizing brace 10 of the present subject matter can be removably secured to a handgun, particularly a heavy pistol, which allows a user to utilized the HWSB 10 to better control, support and steady the heavy pistol to which it is removably secured when the brace section 15 is placed against the front torso of the user's body below the shoulder and the wedge section 14 is place between the side of the user's torso below the shoulder and upper arm. This bracing arrangement provides far better control, support, and steadiness than devices which brace against or envelope the front of the shoulder, front of the upper arm, or the forearm.

While several illustrative embodiments of the invention have been shown and described, numerous variations and alternative embodiments will occur to those skilled in the art. Such variations and alternative embodiments are contemplated and can be made without departing from the scope of the invention as defined in the appended claims.

The invention claimed is:

1. A handgun wedge stabilizing brace designed to contact and engage a user's front torso comprising a stabilizing body and a support member, wherein a. said stabilizing body comprises a pipe section provided with a narrow tubular passage, a wedge section terminating into a pointed end designed to conformingly fit within a gap between the user's side body torso below the shoulder and upper arm, and a brace section, both of said wedge section and said brace section protruding from said pipe section to form a triangular shape, said brace section being provided with a sufficient surface area to laterally brace against the part of the user's front torso, b. said support member is in the form of an obtusely angled tube comprising a horizontal tubular portion having a proximal end and a distal end and a vertical tubular portion having a proximal end and a distal end, said proximal end of said vertical tubular portion extending upwardly at an angle from said distal end of said horizontal tubular portion, said proximal end of said horizontal tubular portion being designed to be telescopically received into said tubular passage of said pipe section, thereby detachably connecting said support member from said stabilizing body, wherein said distal end of said vertical tubular portion is configured to be removably connected to the rear end of a handgun.

2. The handgun wedge stabilizing brace in accordance with claim 1, wherein said horizontal tubular member can be telescopically adjusted within said tubular passage by a locking mechanism.

3. The handgun wedge stabilizing brace in accordance with claim 1, wherein said support member is manufactured as a single piece.

4. The handgun wedge stabilizing brace in accordance with claim 1, wherein said horizontal tubular portion of said support member is coupled to said vertical tubular portion.

5. The handgun wedge stabilizing brace in accordance with claim 1, wherein both said stabilizing body and said support member are composed of a rigid material.

6. The handgun wedge stabilizing brace in accordance with claim 5, wherein both said stabilizing body and said support member are composed of the same rigid material.

7. The handgun wedge stabilizing brace in accordance with claim 5, wherein said rigid material is composed of a plastic material.

8. The handgun wedge stabilizing brace in accordance with claim 5, wherein said rigid material is composed of a metal material.

9. The handgun wedge stabilizing brace in accordance with claim 5, wherein said stabilizing body is composed of a first rigid material and said support member is composed of a second rigid material different from said first rigid material.

10. The handgun wedge stabilizing brace in accordance with claim 1, wherein said distal end of said vertical tubular portion is configured to be removably connected to the rear end of a heavy pistol.

11. The handgun wedge stabilizing brace in accordance with claim 10, wherein said vertical tubular portion is removably connected to the rear end of a heavy pistol having an integral buffer tube and wherein said vertical tubular portion is coupled to the integral buffer tube.

12. The handgun wedge stabilizing brace in accordance with claim 11, wherein said vertical tubular portion is coupled to the integral buffer tube by a clamping mechanism.

13. The handgun wedge stabilizing brace in accordance with claim 1, further comprising a tubular member that is securely attached to the rear end of a heavy pistol and extends rearwardly outward therefrom, wherein said vertical tubular portion is coupled to said tubular member thereby removably connecting said handgun wedge stabilizing brace to the rear end of a heavy pistol.

14. The handgun wedge stabilizing brace in accordance with claim 13, wherein said tubular member is securely attached to the rear end of a heavy pistol by bracketing means.

15. The handgun wedge stabilizing brace in accordance with claim 1, wherein when said handgun wedge stabilizing brace is removably connected to a handgun and said brace section is place against the front torso of a user and said wedge section is placed between the side of the user's torso below the shoulder and upper arm, the user experiences greater control, support and steadiness when utilizing a handgun.

16. The handgun wedge stabilizing brace in accordance with claim 15, wherein said handgun is a heavy pistol.

* * * * *